US007100708B2

(12) United States Patent
Koederitz

(10) Patent No.: US 7,100,708 B2
(45) Date of Patent: Sep. 5, 2006

(54) AUTODRILLER BIT PROTECTION SYSTEM AND METHOD

(75) Inventor: William L. Koederitz, Cedar Park, TX (US)

(73) Assignee: Varco I/P, Inc., Houston, TX (US)

( * ) Notice: Subject to any disclaimer, the term of this patent is extended or adjusted under 35 U.S.C. 154(b) by 193 days.

(21) Appl. No.: 10/745,247

(22) Filed: Dec. 23, 2003

(65) Prior Publication Data

US 2005/0133259 A1 Jun. 23, 2005

(51) Int. Cl.
*E21B 44/02* (2006.01)
*E21B 19/08* (2006.01)

(52) U.S. Cl. ..... 175/27; 175/39; 175/48

(58) Field of Classification Search ..... None
See application file for complete search history.

(56) References Cited

U.S. PATENT DOCUMENTS

| | | | | |
|---|---|---|---|---|
| 3,605,919 A | | 9/1971 | Bromell et al. | |
| 4,507,735 A | * | 3/1985 | Moorehead et al. | 702/9 |
| 4,549,431 A | | 10/1985 | Soeiinah | 73/152.49 |
| 4,553,429 A | | 11/1985 | Evans et al. | 73/152.21 |
| 4,606,415 A | | 8/1986 | Gray, Jr. et al. | |
| 4,616,321 A | * | 10/1986 | Chan | 702/9 |
| 4,685,329 A | | 8/1987 | Burgess | |
| 4,793,421 A | | 12/1988 | Jasinski | 175/27 |
| 4,875,530 A | | 10/1989 | Frink et al. | 175/27 |
| 5,273,112 A | | 12/1993 | Schultz | 166/374 |
| 5,368,108 A | | 11/1994 | Aldred et al. | 175/40 |
| 5,465,798 A | | 11/1995 | Edlund et al. | 175/24 |
| 5,597,042 A | | 1/1997 | Tubel et al. | 166/250.01 |
| 5,662,165 A | | 9/1997 | Tubel et al. | 166/250.01 |
| 5,706,896 A | | 1/1998 | Tubel et al. | 166/313 |
| 5,713,422 A | | 2/1998 | Dhindsa | 175/27 |
| 5,730,219 A | | 3/1998 | Tubel et al. | 66/250.01 |
| 5,732,776 A | | 3/1998 | Tubel et al. | 166/250.15 |
| 5,952,569 A | | 9/1999 | Jervis et al. | |
| 5,955,666 A | | 9/1999 | Mullins | 73/152.18 |
| 5,992,519 A | | 11/1999 | Ramakrishnan et al. | 166/250.15 |
| 6,021,377 A | | 2/2000 | Dubinsky et al. | |
| 6,029,951 A | | 2/2000 | Guggari | 254/269 |
| 6,233,524 B1 | | 5/2001 | Harrell et al. | |

(Continued)

FOREIGN PATENT DOCUMENTS

GB 2 335 450 3/1999

OTHER PUBLICATIONS

PCT/GB2004/050045: Int'l Search Report: 4 pp.: Mar. 22, 2005.
PCT/GB2004/050045: PCT Written Opinion: 5 pp.: Mar. 22, 2005.

*Primary Examiner*—Zakiya W. Bates
(74) *Attorney, Agent, or Firm*—Guy McClung

(57) ABSTRACT

A controller provides an automatic bit protection sequence for an autodriller that can be initiated during the initial stage of set down of the bit within the formation. The automatic protection sequence establishes a setpoint for a parameter of interest (such as weight on bit, ROP, torque) associated with operation of the drilling system and then initiates a gradual increase in that parameter in order to achieve the setpoint. The bit protection sequence may be adjustable so that varying degrees of gradualness may be selected. The controller of the autodriller may also be provided with measured data for torque, rate of penetration (ROP) and/or the differential pressure of the mud motor of the drilling system. Each of these parameters is provided with a predetermined setpoint, and each may be selected as the controlling parameter for operation of the autodriller.

16 Claims, 8 Drawing Sheets

U.S. PATENT DOCUMENTS

| | | | | |
|---|---|---|---|---|
| 6,237,404 | B1 | 5/2001 | Crary et al. | 73/152.03 |
| 6,346,813 | B1 | 2/2002 | Kleinberg | 324/303 |
| 6,356,205 | B1 | 3/2002 | Salvo et al. | 340/853.3 |
| 6,382,331 | B1 | 5/2002 | Pinckard | 175/27 |
| 6,438,495 | B1 | 8/2002 | Chau et al. | |
| 6,467,557 | B1 | 10/2002 | Krueger et al. | 175/45 |
| 6,505,682 | B1 | 1/2003 | Brockman | 166/250.15 |
| 6,766,254 | B1 | 7/2004 | Bradford et al. | 702/9 |
| 6,868,920 | B1 | 3/2005 | Hoteit et al. | 175/25 |
| 6,873,267 | B1 | 3/2005 | Tubel et al. | 340/853.3 |
| 2002/0112888 | A1 | 8/2002 | Leuchtenberg | 175/48 |
| 2003/0015351 | A1 | 1/2003 | Goldman et al. | 175/39 |
| 2003/0220742 | A1 | 11/2003 | Niedermayr et al. | 702/9 |
| 2004/0040746 | A1 | 3/2004 | Niedermayr et al. | 175/38 |
| 2004/0195004 | A1* | 10/2004 | Power et al. | 175/24 |

* cited by examiner

AUTODRILLER BIT PROTECTION SYSTEM AND METHOD

BACKGROUND OF THE INVENTION

1. Field of the Invention

The invention relates generally to systems for drilling boreholes for the production of hydrocarbons. More particularly, the invention relates to devices and methods for protecting the bit during the initial stages of the drilling operation in order to extend the lifetime of the bit.

2. Description of the Related Art

To obtain hydrocarbons such as oil and gas, boreholes are drilled by rotating a drill bit attached at a drill string end. Modem drilling systems generally employ a drill string having a bottomhole assembly (BHA) and a drill bit at end thereof that is rotated by a drill motor (mud motor) and/or the drill string. Pressurized drilling fluid (commonly known as the "mud" or "drilling mud") is pumped into the drill pipe to rotate the drill motor and to provide lubrication to various members of the drill string including the drill bit. The drill pipe is rotated by a prime mover, such as a rotary table, to facilitate directional drilling and to drill vertical boreholes.

Boreholes are usually drilled along predetermined paths and the drilling of a typical borehole proceeds through various formations. The drilling operator typically controls the surface-controlled drilling parameters, such as the weight on bit, drilling fluid flow through the drill pipe, the drill bit rotational speed (rpm of the surface motor coupled to the drill pipe) and the density and viscosity of the drilling fluid to optimize the drilling operations. The downhole operating conditions continually change and the operator must react to such changes and adjust the surface-controlled parameters to optimize the drilling operations. For drilling a borehole in a virgin region, the operator typically has seismic survey plots that provide a macro picture of the subsurface formations and a pre-planned borehole path. For drilling multiple boreholes in the same formation, the operator also has information about the previously drilled boreholes in the same formation. Additionally, various downhole sensors and associated electronic circuitry deployed in the BHA continually provide information to the operator about certain downhole operating conditions, condition of various elements of the drill string and information about the formation through which the borehole is being drilled.

Typically, the information provided to the operator during drilling includes drilling parameters, such as WOB, rotational speed of the drill bit and/or the drill string, and the drilling fluid flow rate. In some cases, the drilling operator is also provided selected information about bit location and direction of travel, bottomhole assembly parameters such as downhole weight on bit and downhole pressure, and possibly formation parameters such as resistivity and porosity. Typically, regardless of the type of the borehole being drilled, the operator continually reacts to the specific borehole parameters and performs drilling operations based on such information and the information about other downhole operating parameters, such as bit location, downhole weight on bit and downhole pressure, and formation parameters, to make decisions about the operator-controlled parameters.

During the initial part of a drilling operation, the bit is prone to damage. The BHA must be set down into the formation to be drilled as rotation of the bit is begun. Typically, the driller does this manually. As such, the setting down process may be performed differently each time drilling is begun. If setting down and rotation is begun too quickly, the bit may be damaged by the suddenness of the contact with the rock, or the drill string may become overtorqued. If setting down and rotation are done too slowly, rig time is wasted. This is especially true for a new bit, wherein it must be "drilled in" to establish a new pattern.

A few systems have been proposed for automated operation of portions of a drilling operation. In general, such systems establish a set point for WOB, and then control the drilling equipment to reach the setpoint quickly. This may be counterproductive. Attempting to achieve the setpoint quickly may cause a step-change to the system that results in damage to the bit, overtorquing of the drill string and other problems.

U.S. Pat. No. 4,875,530 issued to Frink et al., for example, describes an automatic drilling system wherein a required speed and bit weight is input into the system by an operator. A controller device electronically senses the weight on bit and provides instantaneous feedback of a signal to a hydraulically driven drawworks which is capable of maintaining precise bit weight throughout varying penetration modes. Frink's system provides a setpoint for the bit weight. However, Frink also seeks to achieve the setpoint quickly and without regard to protection of the bit.

U.S. Pat. No. 6,382,331 issued to Pinckard describes a method and system for optimizing the rate of bit penetration while drilling. Pinckard's arrangement collects information on bit rate of penetration, weight on bit, pump or standpipe pressure, and rotary torque data during drilling. This information is stored in respective data arrays. Periodically, the system performs a linear regression of the data in each of the data arrays with bit rate of penetration as a response variable and weight on bit, pressure, and torque, respectively, as explanatory variables to produce weight on bit, pressure, and torque slope coefficients. The system calculates correlation coefficients for the relationships between rate of penetration and weight on bit, pressure, and torque, respectively. The system then selects the drilling parameter with the strongest correlation to rate of penetration as the control variable. Pinckard's system, however, does not attempt to solve the problems associated with the start of drilling or drilling in of a bit.

There is a need for a system that overcomes the problems associated with prior art systems as regards the starting of drilling.

SUMMARY OF THE INVENTION

The system and methods of the present invention overcome the foregoing disadvantages of the prior art by providing a system that optimizes the drilling process. The system and methods of the present invention seek to provide protection to the bit during the drilling process, and particularly during the initial portion of the drilling operation, when the bit is set down into the formation.

In a preferred embodiment, an autodriller device is provided that operates the drawworks for hoisting/lowering of and rotation of the drill string. The autodriller includes a controller that is programmed to provide an automatic bit protection sequence that can be initiated during the initial stage of set down of the bit within the formation. The automatic protection sequence establishes a setpoint for a parameter of interest that is associated with operation of the drilling system. This parameter of interest may be the actual WOB. It may also be measured torque on the drill string, ROP, or differential mud motor pressure. At the start of drilling, the controller initiates a gradual increase in the parameter of interest in order to achieve the setpoint. The controller may be provided with an on/off switch so that the driller may selectively choose to use or not use the bit protection process. Additionally, the bit protection sequence may be adjustable so that varying degrees of gradualness may be selected.

In a further embodiment of the present invention, the controller of the autodriller is provided with measured data for the torque on the BHA, rate of penetration (ROP) and/or the differential pressure of the mud motor of the drilling system. Each of these parameters is provided with a predetermined setpoint, and each may be selected as the controlling parameter for operation of the autodriller. In yet a further embodiment, the controller will automatically select a controlling parameter from among these parameters.

Examples of the more important features of the invention thus have been summarized rather broadly in order that the detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, wherein.

DETAILED DESCRIPTION OF PREFERRED EMBODIMENTS

Figure 1:
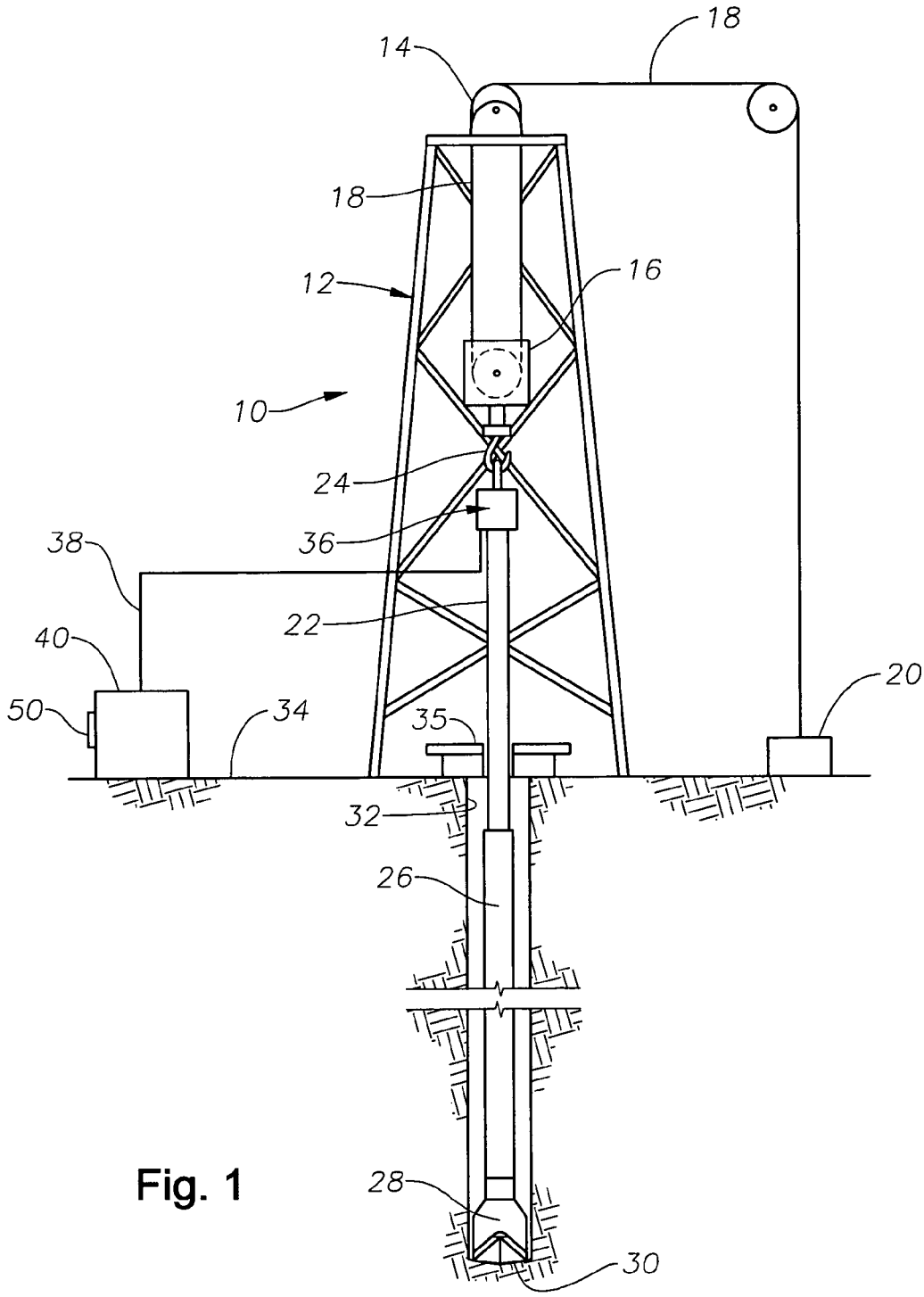
FIG. 1 is a schematic depiction of an exemplary drilling system having an autodriller and which incorporates a system constructed in accordance with the present invention.

FIG. 1 illustrates, in schematic fashion, an exemplary drilling rig 10 with an automatic drilling system. The rig 10 includes a supporting derrick structure 12 with a crown block 14 at the top. A traveling block 16 is moveably suspended from the crown block 14 by a cable 18, which is supplied by draw works 20. A kelly 22 is hung from the traveling block 16 by a hook 24. The lower end of the kelly 22 is secured to a drill string 26. The lower end of the drill string 26 has a bottom hole assembly 28 that carries a drill bit 30. The drill string 26 and drill bit 30 are disposed within a borehole 32 that is being drilled and extends downwardly from the surface 34. The kelly 22 is rotated within the borehole 32 by a rotary table 35. Other features relating to the construction and operation of a drilling rig, including the use of mud hoses, are well known in the art and will not be described in any detail herein.

A load cell assembly, generally shown at 36, is disposed below the traveling block 16. The load cell assembly 36 is of a type known in the art and contains a sensor for measuring the entire weight of the drill string 26 and kelly 22 below it. It is noted that the load cell assembly 36 might also be located elsewhere, the location shown in FIG. 1 being but an exemplary location for it. A suitable alternative location for the load cell assembly 36 would be to incorporate the load cell assembly into the cable 18 to measure tension upon the cable 18 from loading of the drill string 26 and kelly 22.

The load cell assembly 36 is operably interconnected via cable 38 to a controller 40. The controller 40 is typically contained within a housing (not shown) proximate the derrick structure 12. The controller 40 is preferably programmable and embodied within a drawworks control system, or autodriller, of a type known in the art for control of the raising and lowering, rotation, torque and other aspects of drill string operation. One such autodriller, which is suitable for use with the present invention, is that described in U.S. Pat. No. 6,029,951, issued to Guggari. That patent is owned by the assignee of the present application and is herein incorporated by reference. The controller 40 is operably interconnected with the drawworks 20 for control of the payout of cable 18 which, in turn, will raise and lower the drill string 26 within the wellbore 32. Additionally, the controller 40 is operably associated with the rotary table 35 for control of rotation of the drill string 26 within the wellbore 32.

Prior to lowering the drill string 26 into the wellbore 32 to engage the bottom of the wellbore 32, the load cell assembly 36 provides a reading to the controller 40 that is a baseline "zero" WOB. This zero reading is indicative of the load on load cell assembly 36 with just the hookload, i.e., the kelly 22, drill string 26 and BHA 28. In other words, with this hookload, the actual weight on the bit 30 is essentially zero since the bit is hanging free and has not yet been set down into the wellbore 32. The actual WOB is determined by subtracting the reference hookload value from the reading provided by the load cell assembly 36. As the bit 30 is lowered into the wellbore 32, and prior to the bit 30 engaging the formation, mud pumps are started to flow drilling mud down through the drill string 26 for lubrication of the bit 30. Because this operation is well understood by those of skill in the art, it is not described in any detail herein. Additionally, rotation of the drill string 26 is started. As the drill string 26 and BHA 28 are further lowered into the wellbore 32, the bit 30 eventually will be brought into contact with the bottom of the wellbore 32, as the BHA 28 is set down. At this point, the reading on the load cell assembly 36 will be decreased as the weight of the hookload is born by the bit 30. The decrease in weight on the load cell assembly 36 provides a measurement of the increase in WOB. The controller 40 can selectively adjust the rate of increase of WOB by controlling the braking force provided by the drawworks 20 on cable 18. The controller 40 is preprogrammed with a WOB set point, which is typically selected by the driller prior to the commencement of drilling operations.

Figure 2:
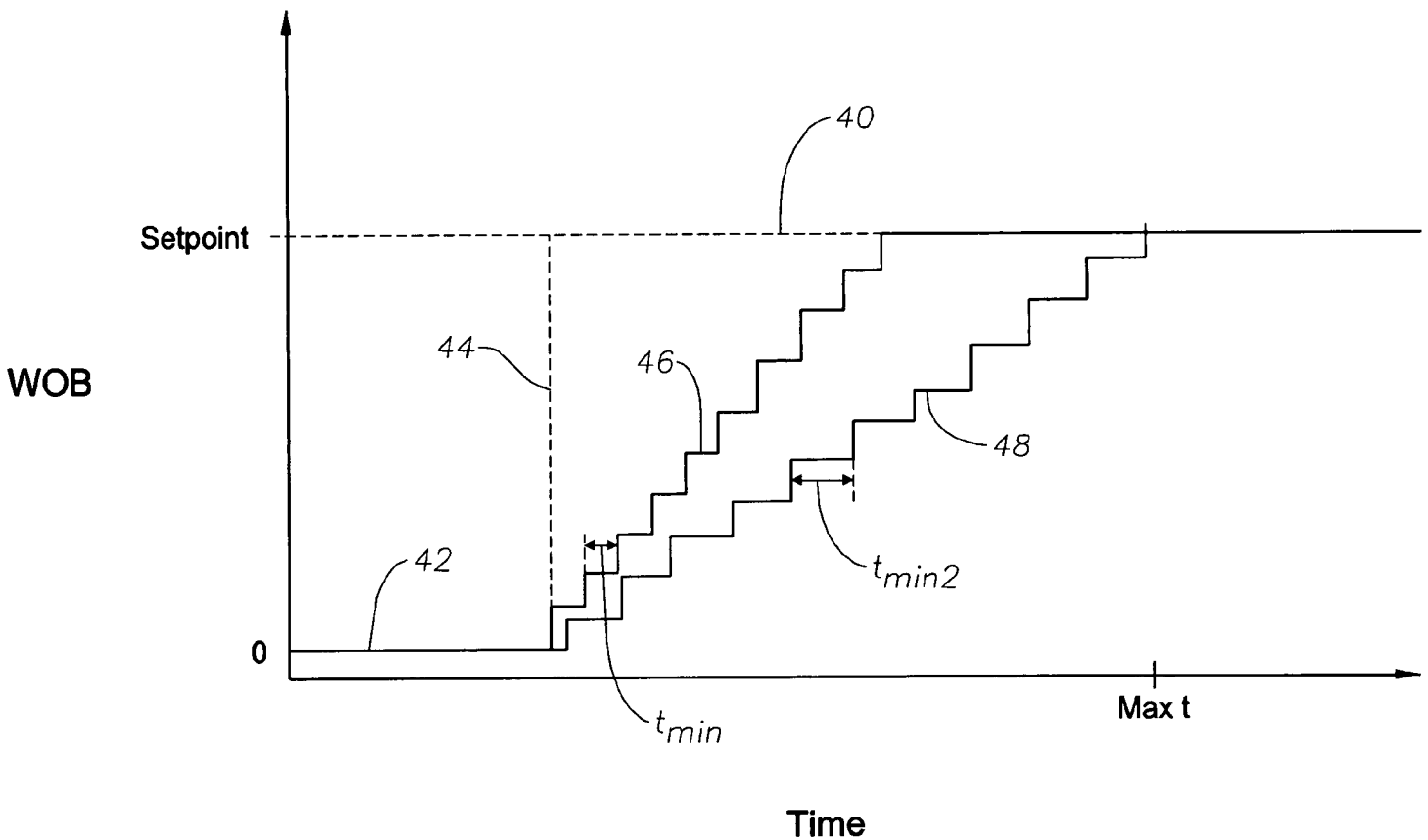
FIG. 2 is a chart illustrating controlled gradual achievement of a bit weight setpoint.

When in the "bit protection mode," the controller 40 seeks to adjust the WOB toward a WOB setpoint in a gradual manner. FIG. 2 is a graph that illustrates gradual adjustment of the actual WOB toward the WOB setpoint in a gradual manner. FIG. 2 depicts the actual weight on bit (WOB) versus time for the setting down portion of a drilling operation. A WOB setpoint is shown at line 40, indicating a desired WOB for the drilling operation. The actual zero WOB, prior to set down, is indicated by line 42. Line 44 depicts a rapid, step-change-type adjustment of the WOB toward the setpoint 40. This is undesirable. Line 46 illustrates a gradual increase in the actual WOB 42 toward the setpoint WOB 40, in accordance with the present invention. As will be described in greater detail below, the controller 40 accomplishes this gradual increase by ensuring that weight is added to the bit 30 in discrete increments and that there is an increment of time ($t_{min}$) between additions of each increment of added weight. The stair step appearance of the line 46 is due to the placement of the increment of time ($t_{min}$) between each increase in weight.

Line 48 also illustrates a gradual increase in the actual WOB 42 to the setpoint WOB 40. As is apparent, there is a greater degree of gradualness in reaching the setpoint WOB 40 along the second line 48. This greater degree of gradualness is due to the use of a longer minimum time period ($t_{min2}$). In the latter instance, also, the controller 40 has been programmed to increase the actual WOB to the setpoint WOB 40 within a set period of time (max t), or target time. The driller may specify a target time (max t) by inputting this parameter into the controller 40 for the actual WOB to be brought to the WOB setpoint. In this way, the degree of gradualness may be adjusted.

Figure 2A:
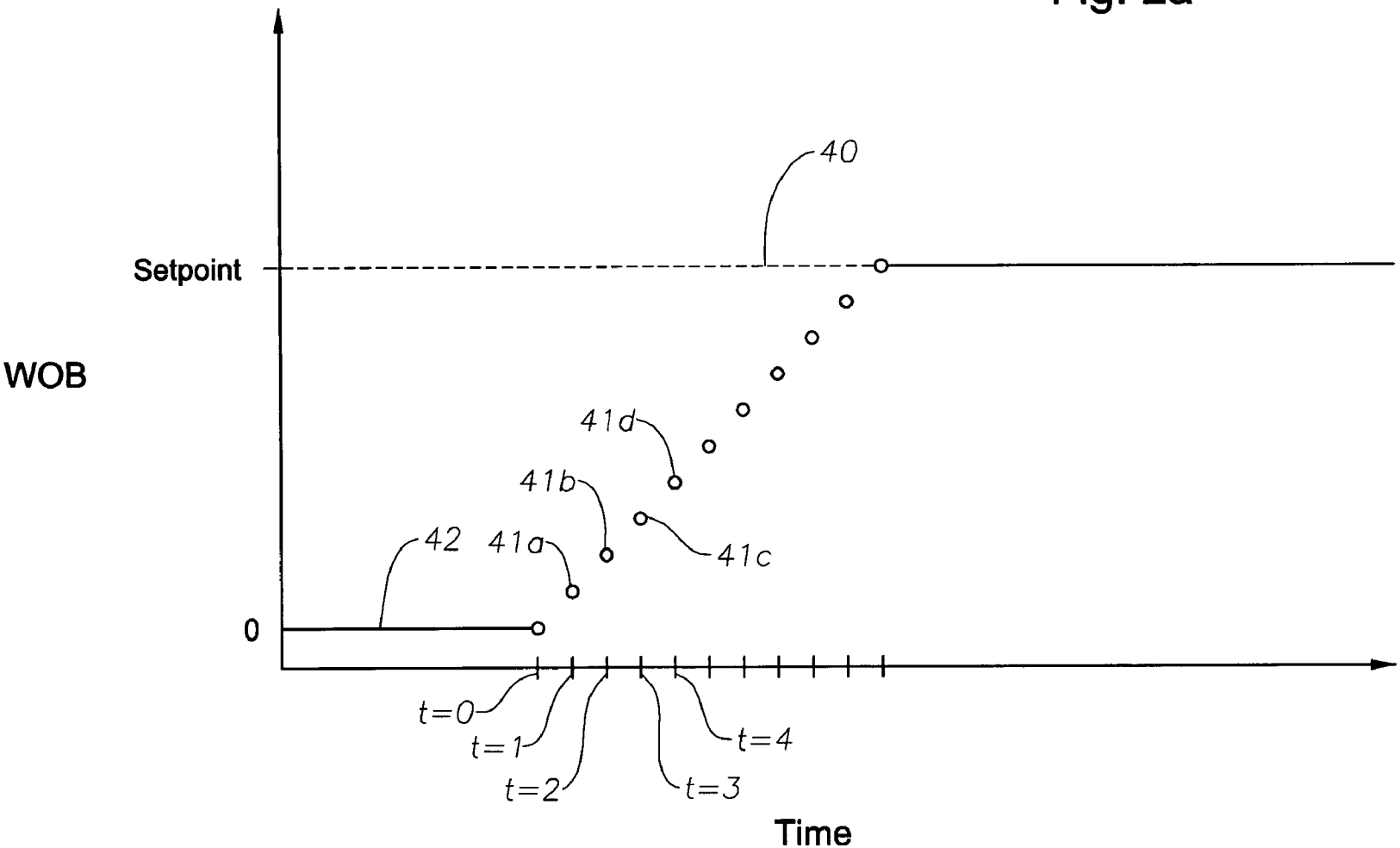
FIG. 2*a* depicts an alternative technique for providing controlled gradual achievement of a bit weight setpoint.

An alternative method for increasing the weight on bit in a gradual manner is illustrated by FIG. 2*a*. According to this method, the controller 40 calculates intermediate setpoints for the WOB at various points in time from the beginning of drilling to achievement of the setpoint. The controller 40 will control the drawworks 20 to maintain the actual WOB at the intermediate setpoints. FIG. 2*a* shows an example. In this example, the setpoint 40 has been established prior to the start of drilling. At the start of drilling, t=0 in FIG. 2*a*. The controller 40 then calculates an intermediate setpoint (shown as intermediate setpoint 41*a* in FIG. 2*a*) for the actual WOB for a specific point in time (i.e., t=1) after the start of drilling. The controller 40 then controls the drawworks 20 to increase the actual WOB to this intermediate setpoint. The controller 40 will also calculate additional intermediate setpoints 41*b*, 41*c*, 41*d*, etc. for subsequent time periods (t=2; t=3; t=4, . . . ) and continuing until the actual WOB reaches the WOB setpoint 40. The intermediate setpoints 41*a*, 41*b*, 41*c*, . . . may be calculated using known mathematical techniques for determining intermediate values between two known endpoints. One suitable technique for making such a determination is the slope-intercept form of linear equation:

$y=mx+b$ where:

m=slope;

b=the value where the line crosses the y-axis; and x and y are the coordinates for the y-intercept.

Figure 3:
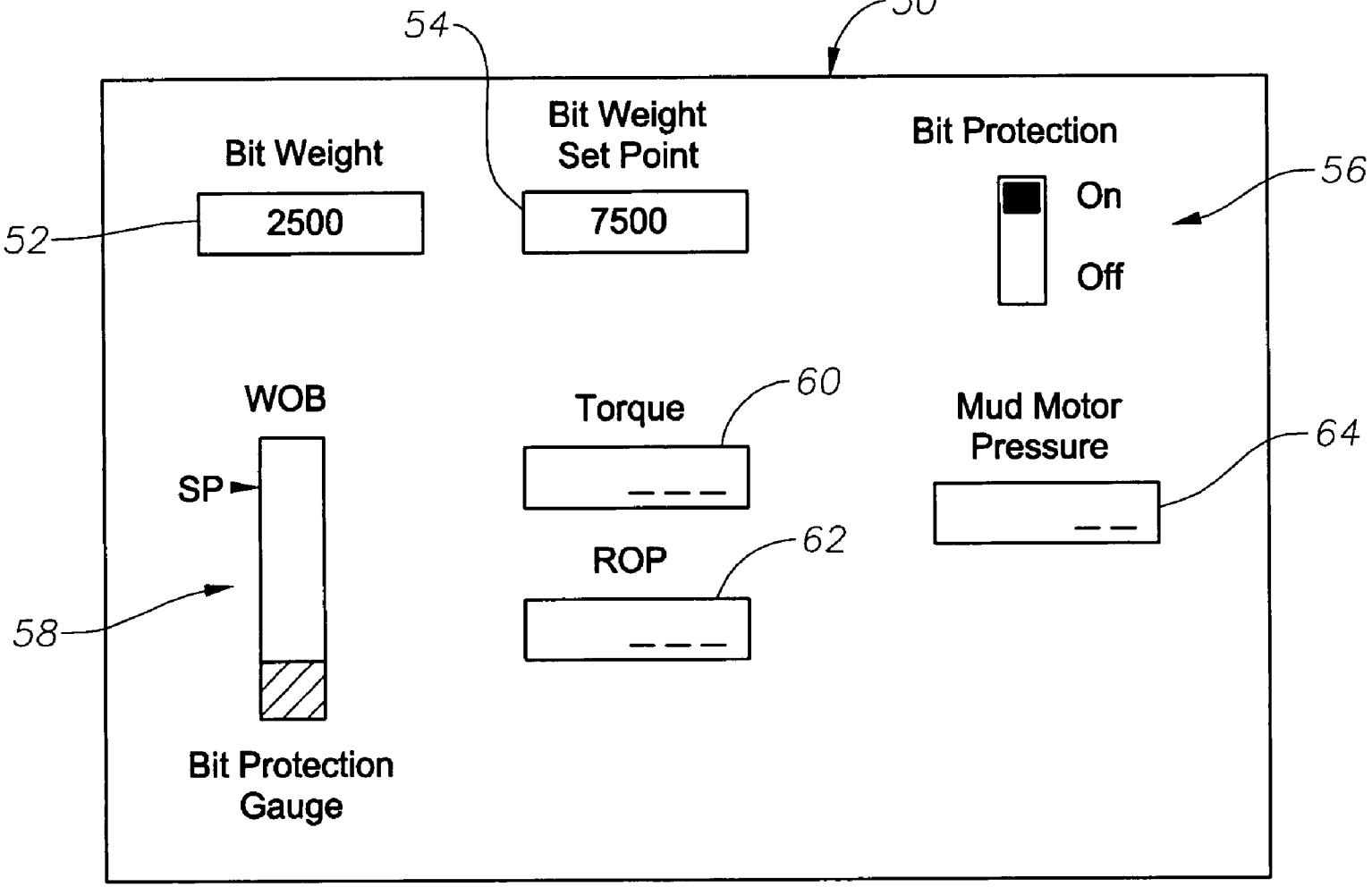
FIG. 3 depicts portions of an exemplary display panel for the controller of the autodriller device.

A display/control panel is associated with the controller 40 so that a driller may have actuation control over the controller 40 and to have a visual indication of the actual WOB, WOB setpoint, and other parameters. FIG. 3 illustrates a portion of an exemplary display/control panel 50. The panel 50 presents numerical representations of the actual WOB 52 and the WOB set point 54. The latter value is typically input into the controller 40 by a keyboard or other input device that is known in the art. The panel 50 also provides a control switch 56 for turning the bit protection feature on and off. Additionally, there is a bit protection gauge 58 that will graphically depict the increase in actual WOB toward the setpoint WOB. Additionally, the panel 50 provides a numerical display 60 for torque, as measured at the surface. As those of skill in the art recognize, torque may be measured at the bit by a sensor (not shown) located proximate the rotary table 35. Because the measurement and monitoring of torque upon the drill string is well understood in the art, it will not be described herein. The panel 50 also provides a numerical display 62 for the rate of penetration (ROP) of the bit 30 and a display 64 for the differential pressure of the mud motor (not shown) that is associated with the drilling rig 10 to supply drilling mud to the bit 30.

Figures 4A, 4B, 4C, 4D:
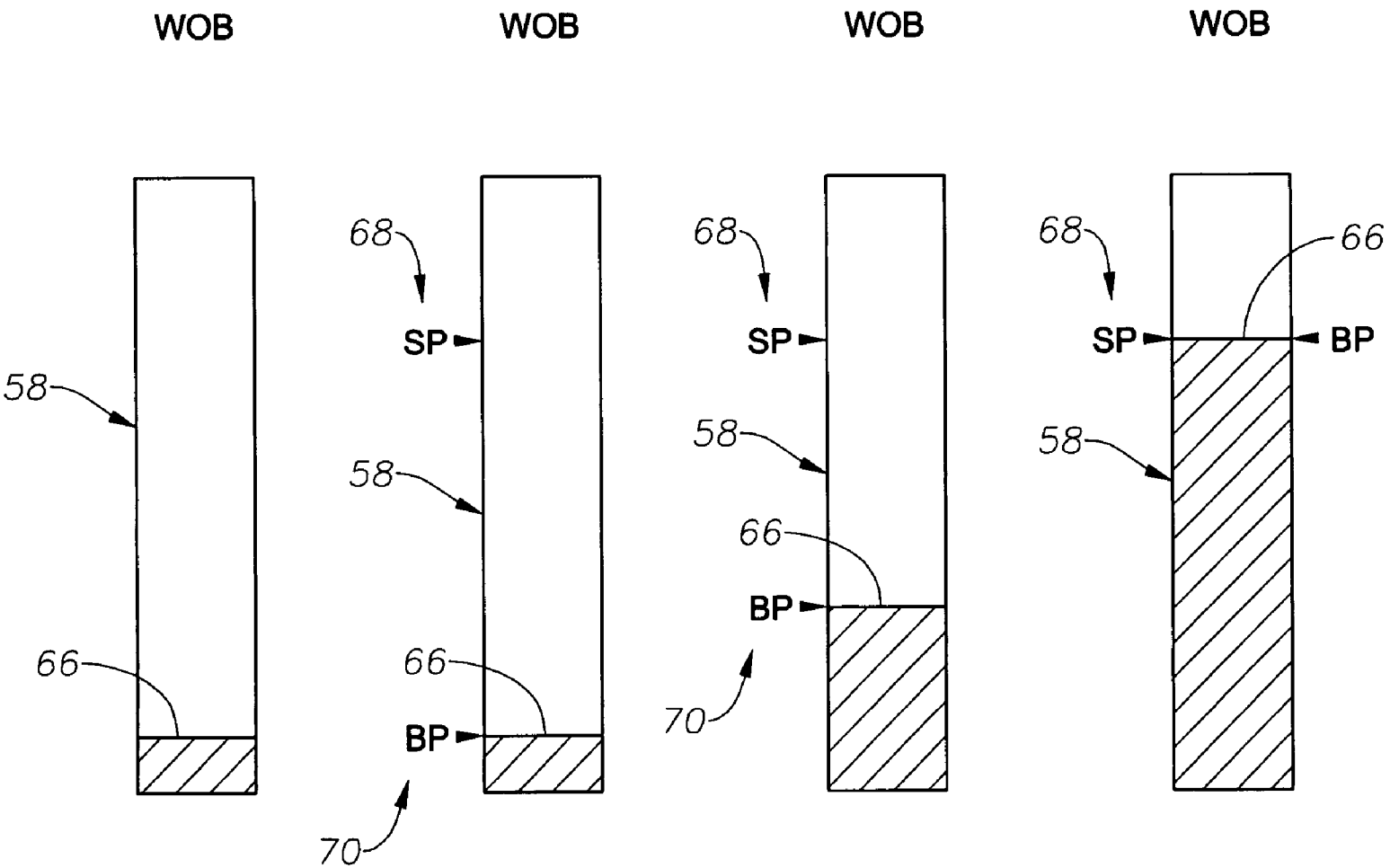
FIGS. 4*a*, 4*b*, 4*c*, and 4*d* illustrate operation of an exemplary display gauge for the automatic protection sequence.

FIGS. 4*a*–4*d* illustrate operation of the bit protection gauge 58 during the initial portion of a drilling operation, principally during the time that the bit 30 is "set down" into the formation or earth for the start of drilling. In FIG. 4*a*, the actual WOB is at the baseline or zero value, indicated by the top of the colored area 66, which represents the actual WOB. At this point, no WOB setpoint has been input into the controller 40. In FIG. 4*b*, a WOB setpoint has been input into the controller 40 and is indicated by the graphical arrow "SP" indicator 68. In addition, the driller has actuated the switch 56 to turn on the bit protection feature, and this is illustrated by the graphical arrow "BP" indicator 70, which is aligned with the top of the colored area 66. In FIG. 4*b*, the bit 30 has not yet been set down. In FIG. 4*c*, the controller 40 is setting the bit 30 down in a gradual manner, and the actual WOB indicator 66 rises. In FIG. 4*d*, the actual WOB has reached the desired setpoint WOB. The "BP" indicator 70 then disappears, showing that the bit protect feature is no longer active.

Figure 5:
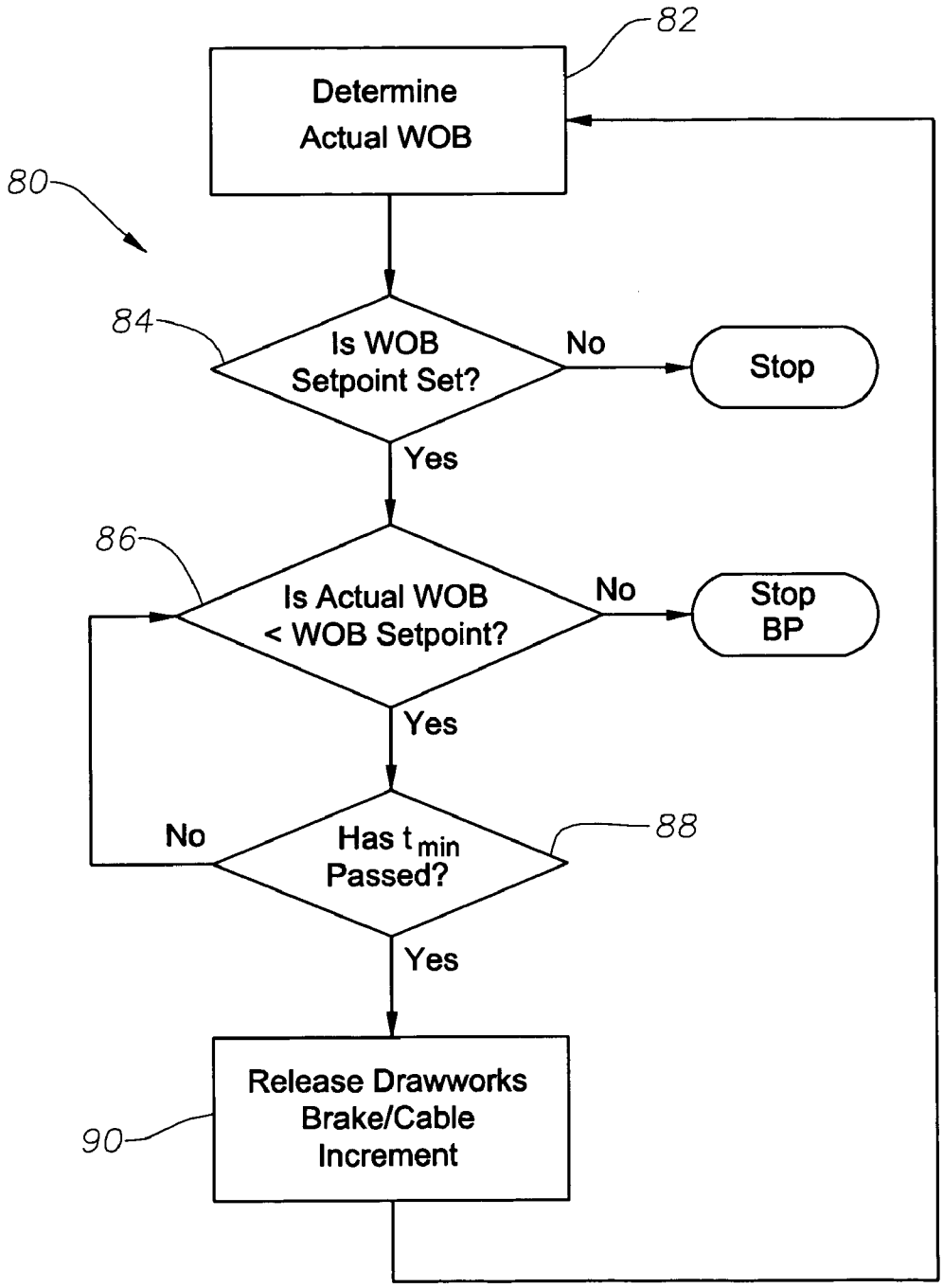
FIG. 5 is a flowchart depicting steps in an exemplary method of control in accordance with the present invention.

In accordance with the present invention, the controller 40 is programmed to provide a "bit protection" operating sequence. The sequence protects the bit and other components from damage that might result during a too rapid increase in WOB during setdown. FIG. 5 depicts a flowchart showing steps in an exemplary control method 80 that is performed by the controller 40 in accordance with the present invention during operation of the bit protect feature. According to the method 80, the controller first determines the actual WOB, which is provided by the load cell assembly 36. This is shown at step 82. In step 84, the controller 40 determines if the autodriller is on and there has been a WOB setpoint entered by the driller. If so, the controller 40 compares the two values in step 86. If the actual WOB is not less than the setpoint WOB, the controller 40 takes no action and the bit protection sequence is stopped. However, if the actual WOB is less than the setpoint WOB, the controller 40 proceeds to step 88 wherein the controller 40 determines whether the minimum interval of time $t_{min}$ (or $t_{min2}$) has passed before additional weight may be placed upon the bit 30. If not, the controller 40 takes no action. If $t_{min}$ (or $t_{min2}$) has occurred since additional weight was placed on the bit 30, the controller 40 proceeds to step 90 wherein the brake (not shown) for the drawworks 20 is released by the controller 40 to cause a predetermined increment of cable to be unwound, thereby placing an additional increment of weight on the bit 30. Depending upon the particular type of drawworks 20 that is used by the drilling rig 10, the controller 40 might adjust an on/off style brake, a continuous brake adjustment, or a motor control. This process 80 will continue in an iterative fashion until the actual WOB is at the setpoint WOB. It is noted that the use of a minimum interval of time between placements of additional weight on the bit 30 ensures that weight is added in a gradual manner. The controller 40 may, alternatively, implement the method described with respect to FIG. 2*a* previously of establishing a plurality of intermediate setpoints and then controlling the drawworks 20 to achieve the intermediate setpoints until the WOB setpoint 40 is reached.

Figure 6:
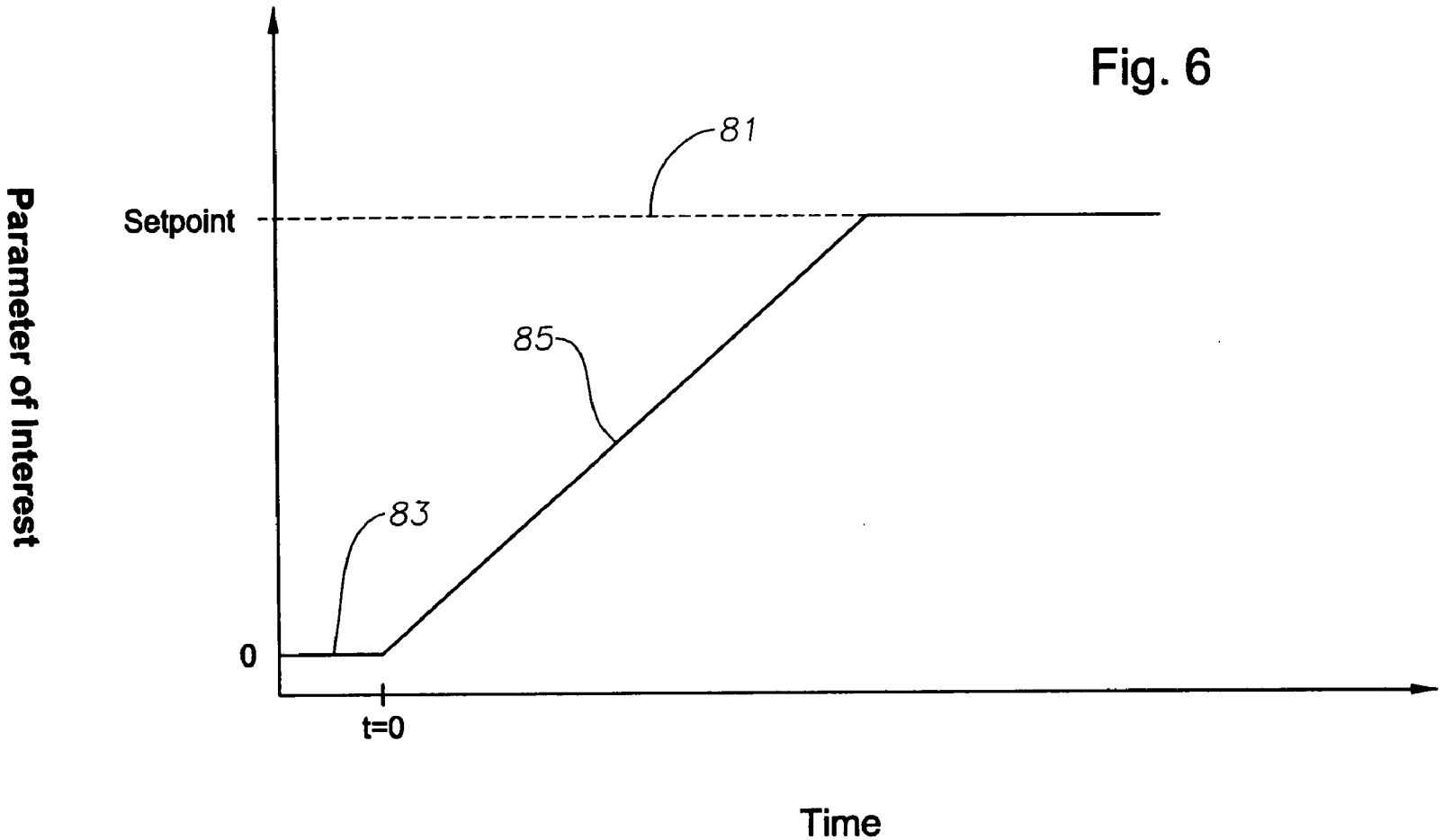
FIG. 6 is a chart depicting control of a parameter of interest associated with the drilling process wherein control is substantially continuous so as to use time steps that approach being infinitely small.

In an alternative embodiment, the processor 40 may be programmed to control the drilling rig 10 using utilize a controlling setpoint that is selected from among other drilling parameters. These other drilling parameters are values that are typically measured and monitored during a drilling operation and include the torque, rate of penetration (ROP) and/or the differential pressure of the mud motor of the drilling system. If, for example, it is desired to use ROP as the controlling parameter, a desired setpoint is selected for ROP. The controller 40 then compares the actual rate of penetration to the ROP setpoint, in the same manner as the actual WOB was compared to the setpoint WOB via process 80 described above. The controller 40 will adjust the payout of cable 18, as previously described, until the actual ROP matches the setpoint ROP. FIG. 6 is a graph that depicts the use of a setpoint 81 and the gradual achievement of that setpoint for a parameter of interest 83. The parameter of interest 83 may be ROP, torque, or differential mud pump pressure, as well as WOB. As depicted generally in FIG. 6, the parameter of interest 83 is increased from the start of drilling at t=0 to the setpoint 81 in a gradual manner, illustrated by line 85 until the setpoint 81 is reached. The gradual increase in the parameter of interest 83 is achieved by the controller 40 using methods previously described for gradual increase of the actual WOB (i.e., use of incremental increases spaced apart by time intervals or the establishment of a plurality of intermediate setpoints for the parameter of interest).

Figure 7:
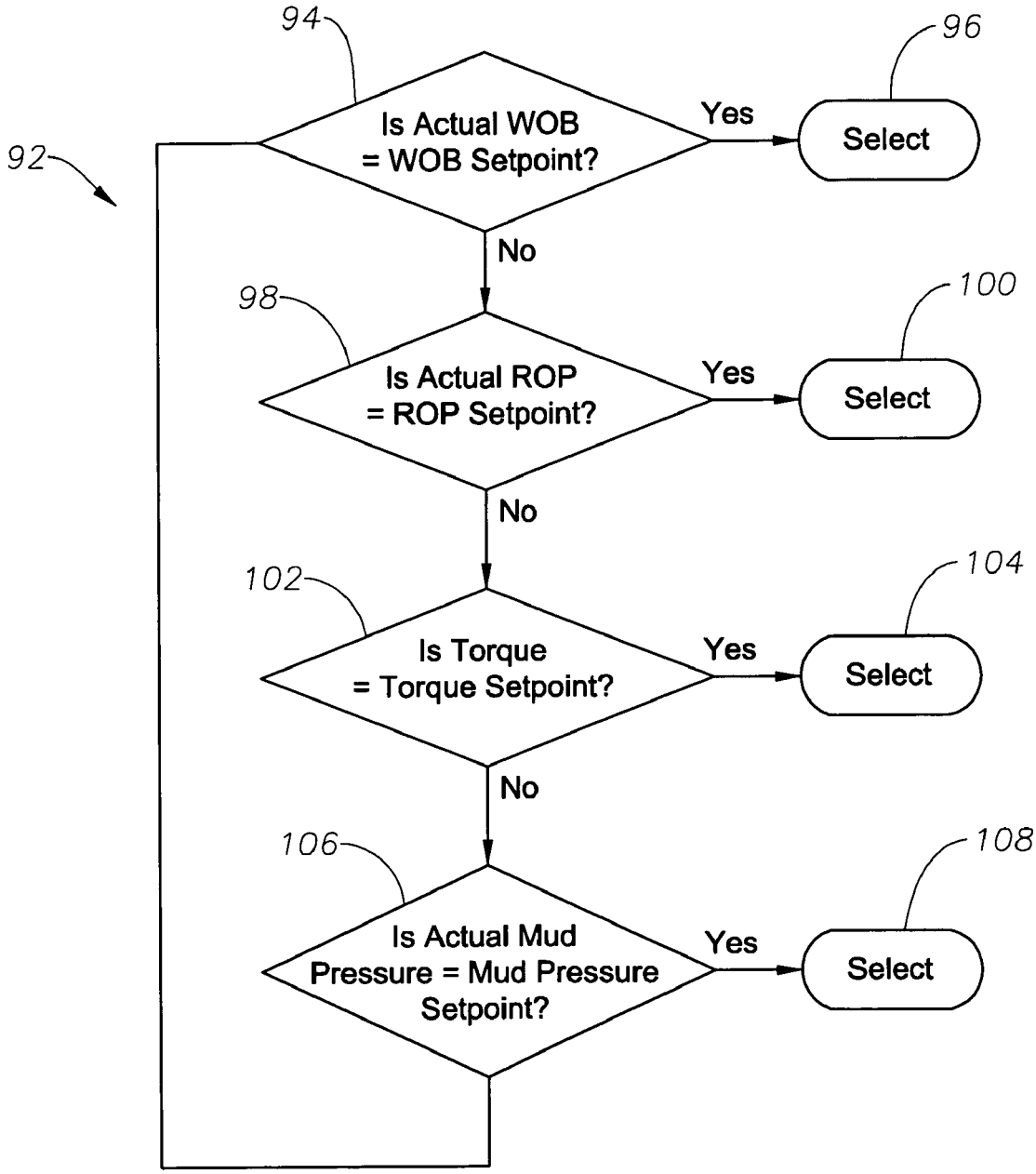
FIG. 7 is a flowchart depicting steps in a further exemplary control method in accordance with the present invention wherein the controller selects a controlling parameter automatically from among several drilling parameters.

In yet a further alternative embodiment of the invention, the controller 40 will automatically select from among the available drilling parameters to use as the controlling parameter of interest. During setdown, the controller 40 monitors each of several drilling parameters, such as WOB, ROP, torque, and mud motor differential pressure. Each of these drilling parameters is assigned a setpoint value. As the controller 40 increases weight on the bit 30, each of these parameters will begin to approach its preestablished, ultimate setpoint (i.e., as WOB is increased, the rate of penetration of the drill bit 30 will also increase). The controller 40 will select the parameter to use as the system setpoint by determining which of the parameters first reaches its setpoint value. FIG. 7 is a flowchart that illustrates an exemplary selection process that might be employed by the controller 40. According to the process, generally designated as 92, the controller first determines whether the actual WOB has reached the WOB setpoint (step 94). If so, the controller 40 selects the WOB setpoint as the setpoint for control of actual WOB (step 96). If the controller 40 determines that the WOB setpoint has not been reached, it then determines whether the actual ROP has reached the ROP setpoint (step 98). If so, then the ROP setpoint is selected as the setpoint for control of ROP (step 100). If the actual ROP has not reached the ROP setpoint, the controller 40 then determines whether torque has reached its predetermined setpoint (step 102). If it has, then the torque parameter is chosen by the controller as the parameter for control of torque (step 104). If not, the controller 40 proceeds to determine whether the actual mud pump pressure has reached the selected setpoint for mud pump pressure (step 106). If so, that parameter is chosen as the controlling parameter (step 108). This process 92 will continue in an iterative fashion until a selection is made. Thus, the first parameter to reach its designated set point will be selected by the controller 40 as the controlling setpoint parameter for operation of the drilling rig 10.

It is noted that the steps for the processes described above may be hardwired into the controller or provided by programming of the controller 40. Additionally, the. steps may be accomplished by using instructions that are provided to the controller via removable storage media, such as diskettes, CD-ROMs and other known storage media. These computer-readable media, when executed by the controller 40, will cause it to control operation of the drilling rig 10 to perform the described methods.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. A method for controlling the placement of weight on a bit of a drilling assembly during the start of a drilling operation, the method comprising the steps of: a) establishing a setpoint for a parameter of interest related to the placement of weight on the bit; b) monitoring the parameter of interest; and c) increasing actual weight on bit in a gradual manner until the setpoint is reached for the parameter of interest, wherein the weight on bit is increased in a gradual manner by establishing a plurality of intermediate setpoints below the setpoint and sequentially moving the weight on bit along the intermediate setpoints.

2. The method of claim 1 wherein the weight on bit is increased in a gradual manner by increasing the weight on bit in discrete increments.

3. The method of claim 2 wherein there are increments of time between the additions of discrete increments of weight on bit.

4. The method of claim 1 wherein the weight on bit is increased to the setpoint within a target time period.

5. The method of claim 1 wherein the setpoint is a setpoint derived from rate of penetration of the bit.

6. The method of claim 1 wherein the parameter of interest is actual weight on bit and the setpoint is a setpoint of actual weight on bit.

7. The method of claim 1 wherein the parameter of interest is torque on a drilling string associated with the drilling assembly, and the setpoint is a setpoint for torque on a drilling string associated with the drilling assembly.

8. The method of claim 1 wherein the parameter of interest is differential pressure of a mud motor for supplying drilling mud to the bit, and the setpoint is a setpoint for differential pressure of a mud motor for supplying drilling mud to the bit.

9. The method of claim 1 wherein the setpoint for the parameter of interest is selected from among a plurality of drilling parameter setpoints.

10. The method of claim 9 wherein the setpoint for the parameter of interest is selected from among said plurality of drilling parameter setpoints by a driller.

11. The method of claim 9 wherein the setpoint for the parameter of interest is selected from among said plurality of drilling parameter setpoints by a programmable controller.

12. A system for providing protection to a drill bit in a drilling assembly during the start of a drilling operation, the system comprising: a) a load sensor for measuring a parameter of interest associated with operation of the drilling assembly; b) a controller to receive the measured parameter of interest and to compare the measured parameter of interest to a predetermined setpoint for the parameter of interest, wherein the controller further adjusts the weight on bit of interest by separating discrete increments of weight by a predetermined time period; and c) the controller further adjusting the actual weight on bit to reach the setpoint in a gradual manner.

13. The system of claim 12 wherein the controller increases the weight on bit in discrete increments of weight.

14. A computer readable medium containing instructions that, when executed, cause a controller to control operation of a drilling assembly according to the following method: a) establishing a setpoint for control of a weight on bit associated with operation of the drilling assembly; b) monitoring the weight on bit; and c) increasing the weight on bit in a gradual manner until the setpoint is reached, wherein the weight on bit is increased in a gradual manner by establishing a plurality of intermediate setpoints below the setpoint and sequentially moving the weight on bit along the intermediate setpoints.

15. The computer readable medium of claim 14 wherein the weight on bit is increased in a gradual manner by increasing the parameter of interest in discrete increments.

16. The computer readable medium of claim 15 wherein there are increments of time between the additions of discrete increments of weight on bit.

* * * * *